US009877622B2

(12) United States Patent
Cunningham

(10) Patent No.: US 9,877,622 B2
(45) Date of Patent: Jan. 30, 2018

(54) AUTOMATIC TOILET SEAT LOWERING DEVICE

(71) Applicant: Jason Cunningham, Lakeland, TN (US)

(72) Inventor: Jason Cunningham, Lakeland, TN (US)

( * ) Notice: Subject to any disclaimer, the term of this patent is extended or adjusted under 35 U.S.C. 154(b) by 17 days.

(21) Appl. No.: 14/873,377

(22) Filed: Oct. 2, 2015

(65) Prior Publication Data

US 2016/0100722 A1 Apr. 14, 2016

Related U.S. Application Data

(60) Provisional application No. 62/063,662, filed on Oct. 14, 2014.

(51) Int. Cl.
*A47K 13/10* (2006.01)

(52) U.S. Cl.
CPC ..... *A47K 13/10* (2013.01)

(58) Field of Classification Search
CPC ..... A47K 13/10
USPC ..... 4/246.1–246.8, 248
See application file for complete search history.

(56) References Cited

U.S. PATENT DOCUMENTS 4,853,988 A * 8/1989 Mutzell ..... A61H 23/04 4/615
4,995,120 A 2/1991 Tager
5,311,619 A 5/1994 Ward
5,819,327 A 10/1998 Miller
5,926,867 A * 7/1999 Buchanan ..... A47K 13/24 353/43
6,151,723 A 11/2000 MacAllister
6,763,530 B2 * 7/2004 Lu ..... A47K 13/10 4/241
8,347,423 B2 1/2013 Baumoel
2003/0154541 A1 * 8/2003 Miller ..... A47K 13/10 4/246.1
2007/0056085 A1 * 3/2007 Dyson ..... A47K 13/10 4/246.1

* cited by examiner

*Primary Examiner* — Christine Skubinna

(74) *Attorney, Agent, or Firm* — Global Intellectual Property Agency, LLC; Jordan Sworen

(57) ABSTRACT

An automatic seat lowering device for lowering a toilet seat after use and teaching a child to use the toilet. The automatic seat lowering device includes a housing, a seat lowering arm, and a laser pointing arm, wherein both arms are pivotally secured to the housing. The seat lowering arm is movable between an upright configuration wherein the toilet seat is able to rest thereagainst and a lowered configuration wherein the seat lowering arm rotates so as to lower the toilet seat. A controller is operably connected to a timer disposed on the housing and operably connected to the seat lowering arm so as to automatically move the seat lowering arm, causing the toilet seat to be lowered after the timer has expired. The laser pointing arm can be directed to point to the interior of a toilet bowl so as to indicate to a child where to urinate.

7 Claims, 4 Drawing Sheets

AUTOMATIC TOILET SEAT LOWERING DEVICE

CROSS REFERENCE TO RELATED APPLICATION

This application claims the benefit of U.S. Provisional Application No. 62/063,662 filed on Oct. 14, 2014. The above identified patent application is herein incorporated by reference in its entirety to provide continuity of disclosure.

BACKGROUND OF THE INVENTION

Field of the Invention

The present invention relates to toilet seat devices. More specifically, the present invention provides an automatic seat lowering device comprising a housing and a seat lowering arm pivotally secured to the housing, wherein the housing is adapted to secure to a toilet and the seat lowering arm is configured to rotate so as to actuate the lowering of a toilet seat by pushing thereon.

When using the restroom, conventionally men lift the seat of a toilet in order to avoid contaminating the seat with urine. However, many men often do not remember to lower the toilet seat after using the restroom. In such an event, the person using the toilet next is required to touch and lower the toilet seat. Touching the toilet seat is unsanitary due to biological contamination that remain thereon.

Additionally, it is difficult for many parents to teach their children to use the toilet. After a child has used the toilet, it is difficult for him or her to lower the toilet seat due to the lack of reach. Further, it is unsanitary for a child to touch a toilet seat due to the biological contamination thereon. Conventional toilet training devices do not automatically lower a toilet seat after use. Therefore, there exists in the prior art a need for a device that can be secured to a toilet in order to automatically lower the seat after use, as well as teach children to use the toilet.

Devices have been disclosed in the prior art that relate to toilet seat devices. These include devices that have been patented and published in patent application publications. These devices generally relate to seat raising or seat lowering devices for a toilet, such as U.S. Pat. No. 4,995,120, U.S. Pat. No. 5,819,327, U.S. Published Patent Application Number 2007/0056085, U.S. Pat. No. 6,151,723, and U.S. Pat. No. 8,347,423.

These prior art devices have several known drawbacks. Some of these devices include a motorized ratcheting mechanism that needs to be installed and incorporated into the operation of the seat, whereas the present invention utilizes an arm configured to rotate and push downwards on the seat so as not to require installation with the seat. Other devices comprise a lever configured to be disposed beneath a toilet seat so as to lift a toilet seat by pushing upwards thereon, however, the lever fails to rotate so as to allow the seat to be lowered. Furthermore, the prior art devices fail to provide a laser mechanism configured to automatically adjust positioning and illuminate a point directed towards the toilet bowl so as to teach children to use the toilet.

In light of the devices disclosed in the prior art, it is submitted that the present invention substantially diverges in design elements from the prior art and consequently it is clear that there is a need in the art for an improvement to existing automatic toilet seat lowering devices. In this regard the instant invention substantially fulfills these needs.

SUMMARY OF THE INVENTION

In view of the foregoing disadvantages inherent in the known types of automatic toilet seat lowering devices now present in the prior art, the present invention provides a new automatic toilet seat lowering device wherein the same can be utilized for providing convenience for the user when automatically lowering a toilet seat and illuminating a point in the toilet so as to indicate to a child where to urinate.

It is therefore an object of the present invention to provide a new and improved automatic toilet seat lowering device that has all of the advantages of the prior art and none of the disadvantages.

It is another object of the present invention to provide an automatic toilet seat lowering device comprising a housing having a front wall, a rear wall, and one or more sidewalls, wherein the rear wall is adapted to be disposed against a toilet.

Another object of the present invention is to provide an automatic toilet seat lowering device further comprising a seat lowering arm pivotally secured to the housing, wherein the seat lowering arm is movable between an upright configuration such that a toilet seat is able to rest thereagainst and a lowered configuration wherein the seat lowering arm is rotated downwards so as to lower the toilet seat.

Yet another object of the present invention is to provide an automatic toilet seat lowering device wherein the seat lowering arm is operably connected to a motor and a timer in order to actuate the rotation thereof after a pre-set time has elapsed.

Yet another object of the present invention is to provide an automatic toilet seat lowering device further comprising a laser pointing arm pivotally secured to the housing, wherein the laser pointing arm comprises a laser light disposed thereon and configured to illuminate a point in the toilet so as to indicate to a child where to urinate.

Another object of the present invention is to provide automatic toilet seat lowering device that may be readily fabricated from materials that permit relative economy and are commensurate with durability.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
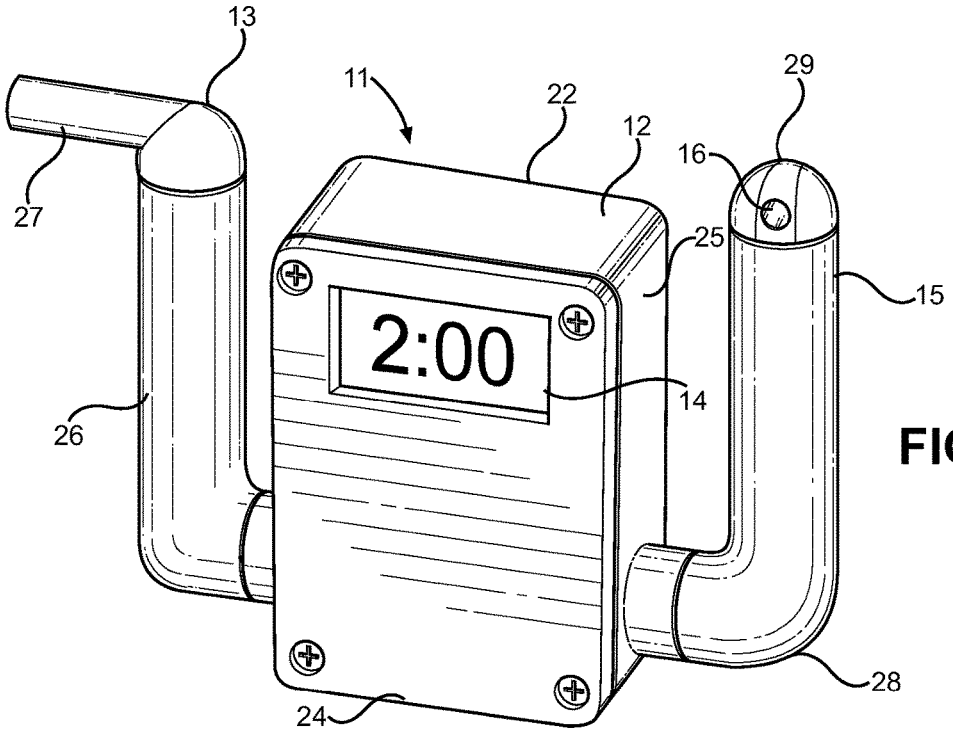
FIG. 1 shows a perspective view of an embodiment of the automatic toilet seat lowering device.

Reference is made herein to the attached drawings. Like reference numerals are used throughout the drawings to depict like or similar elements of the automatic toilet seat lowering device. For the purposes of presenting a brief and clear description of the present invention, the preferred embodiment will be discussed as used for automatically lowering a toilet seat and teaching a child to use the toilet. The figures are intended for representative purposes only and should not be considered to be limiting in any respect.

Figure 2:
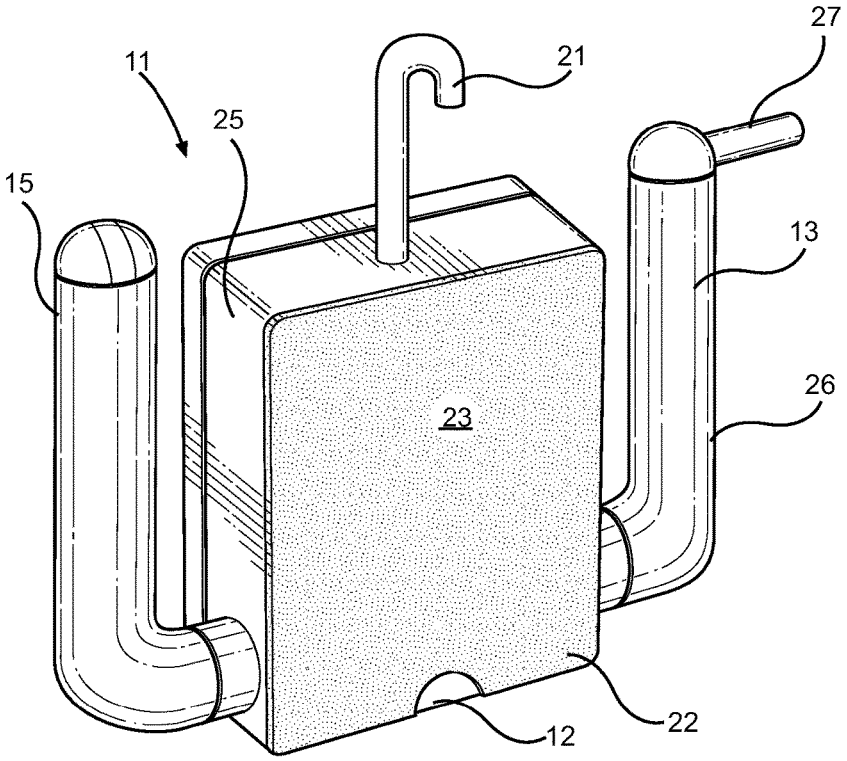
FIG. 2 shows a rear view of an embodiment of the automatic toilet seat lowering device.

Referring now to FIGS. 1 and 2, there is shown a perspective view of an embodiment of the automatic toilet seat lowering device and a rear view of an embodiment of the automatic toilet seat lowering device, respectively. The automatic toilet seat lowering device 11 comprises a housing 12 having a front wall 24, a real wall 22, and one or more sidewalls 25, wherein the rear wall 22 is adapted to rest flush against a toilet and, in some embodiments, secured thereto. In the illustrated embodiment, the housing 12 is rectangular in shape, however, in alternate embodiments the housing 12 can be any suitable shape, such as a dome. The housing 12 comprises operating components that enable the device 11 to automatically lower a toilet seat from a raised position.

The automatic toilet seat lowering device 11 includes one or more attachments mechanisms adapted to secure the housing 12 to a toilet. In some embodiments, the surface 23 of the rear wall comprises an adhesive layer 22 adapted to adhere to the surface of a tank of a toilet. In some embodiments, the rear wall of the housing 12 is curved so as to rest flush against a curved surface of the tank of a toilet. In other embodiments, an attachment mechanism comprises a hook 21 disposed on the upper end of the housing 12 and adapted to secure over the tank of the toilet so as to allow the device 11 to suspend therefrom.

The automatic toilet seat lowering device 11 further includes a seat lowering arm 13 pivotally secured to the housing 12, wherein the seat lowering arm 13 is adapted to rotate and lower the seat of the toilet. The seat lowering arm 13 is further capable of lowering the lid, along with the seat of the toilet. In the illustrated embodiment, the seat lowering arm 13 comprises an L-shaped configuration having a first member 26 extending outward from a sidewall 25 of the housing 12 and a second member 27 extending perpendicularly from the first member 26. Preferably, the seat lowering arm 13 is adapted to be positioned adjacent to the upper end of the tank of the toilet so as to allow the second member 27 to rest behind the toilet seat when the toilet seat is in a raised position. In other embodiments, the seat lowering arm 13 can be any suitable configuration as long as the arm 13 is adapted to lower the toilet seat.

A controller stored within the seat lowering arm 13 is adapted to detect the toilet seat when in the raised position and initiate movement thereof. In the illustrated embodiment, the controller is a micro switch adapted to detect the placement of the toilet seat thereagainst. Further, the micro switch initiates a timer 14 disposed on the housing 12, wherein the timer 14 is pre-set to a desired allowable time that the seat remains in a raised position. Once the timer 14 has elapsed, a motor disposed within the housing 12 is initiated and rotates the seat lowering arm 13 towards the toilet seat that rests thereagainst. The timer 14 includes a display on the front wall 24 of the housing 12 that enables a user to view the time remaining.

The automatic seat lowing device 11 further comprises a laser pointing arm 15 for directing a laser light 16 disposed thereon towards the interior of the toilet bowl. The laser light 16 disposed on the laser pointing arm 15 provides a point of light that is visible in the toilet bowl and indicates to a user, such as a child learning to use the toilet, where he should aim to urinate. In the illustrated embodiment, the laser pointing arm 15 comprises an elongated member having a first end 28 and a second end 29, wherein the first end 28 is disposed on a sidewall 25 of the housing 12. However, in alternate embodiments, the laser pointing arm 15 may be disposed on any location of the housing 12 as long as the laser light 16 can direct a beam of light to the interior of the toilet bowl such that it is unobstructed by any other components of the device 11. The second end 29 of the laser pointing arm 15 includes the laser light 16 thereon.

Figure 3A:
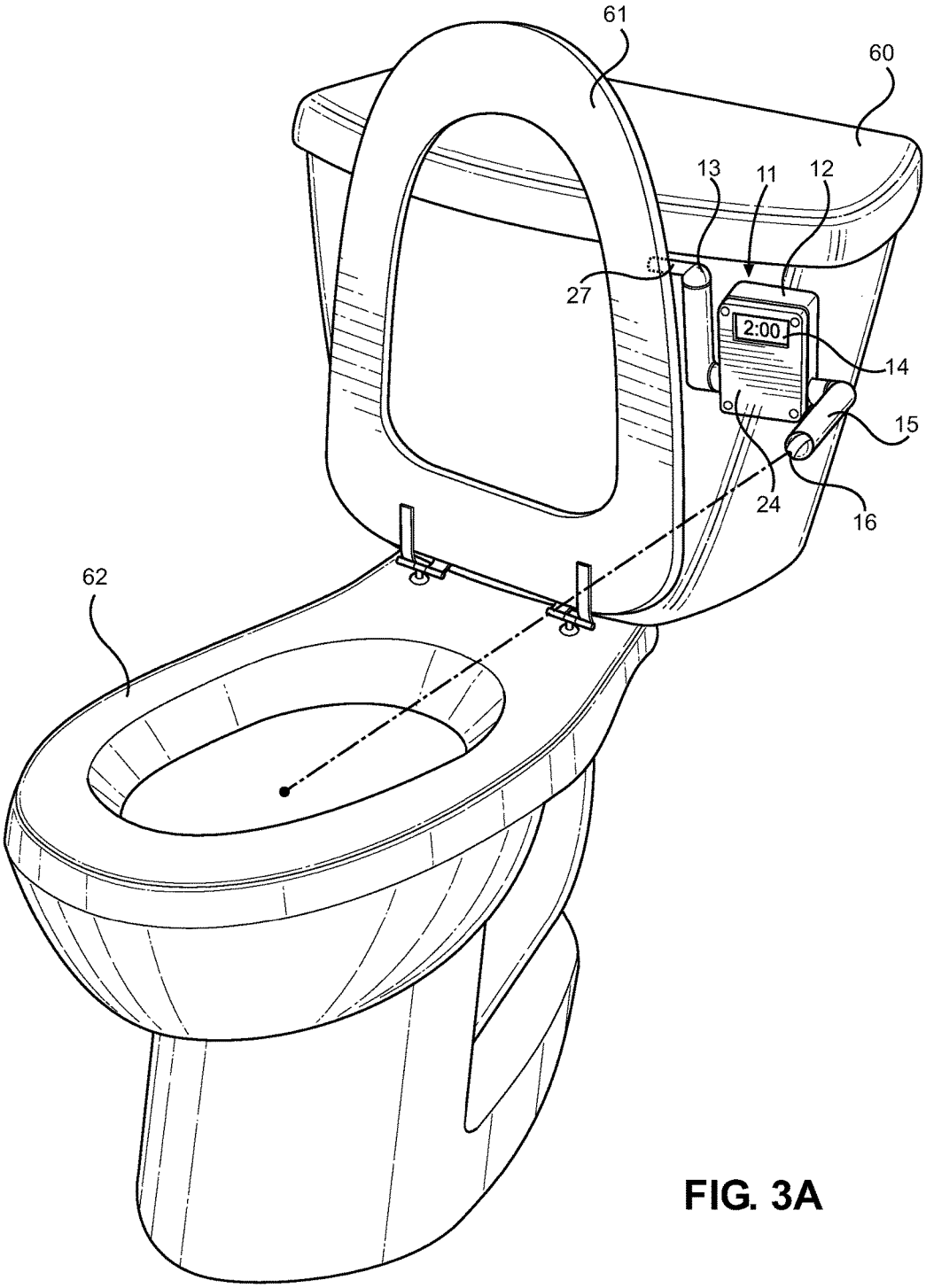
FIG. 3A shows a perspective view of an embodiment of the automatic toilet seat lowering device wherein the seat lowering arm is in an upright configuration.
Figure 3B:
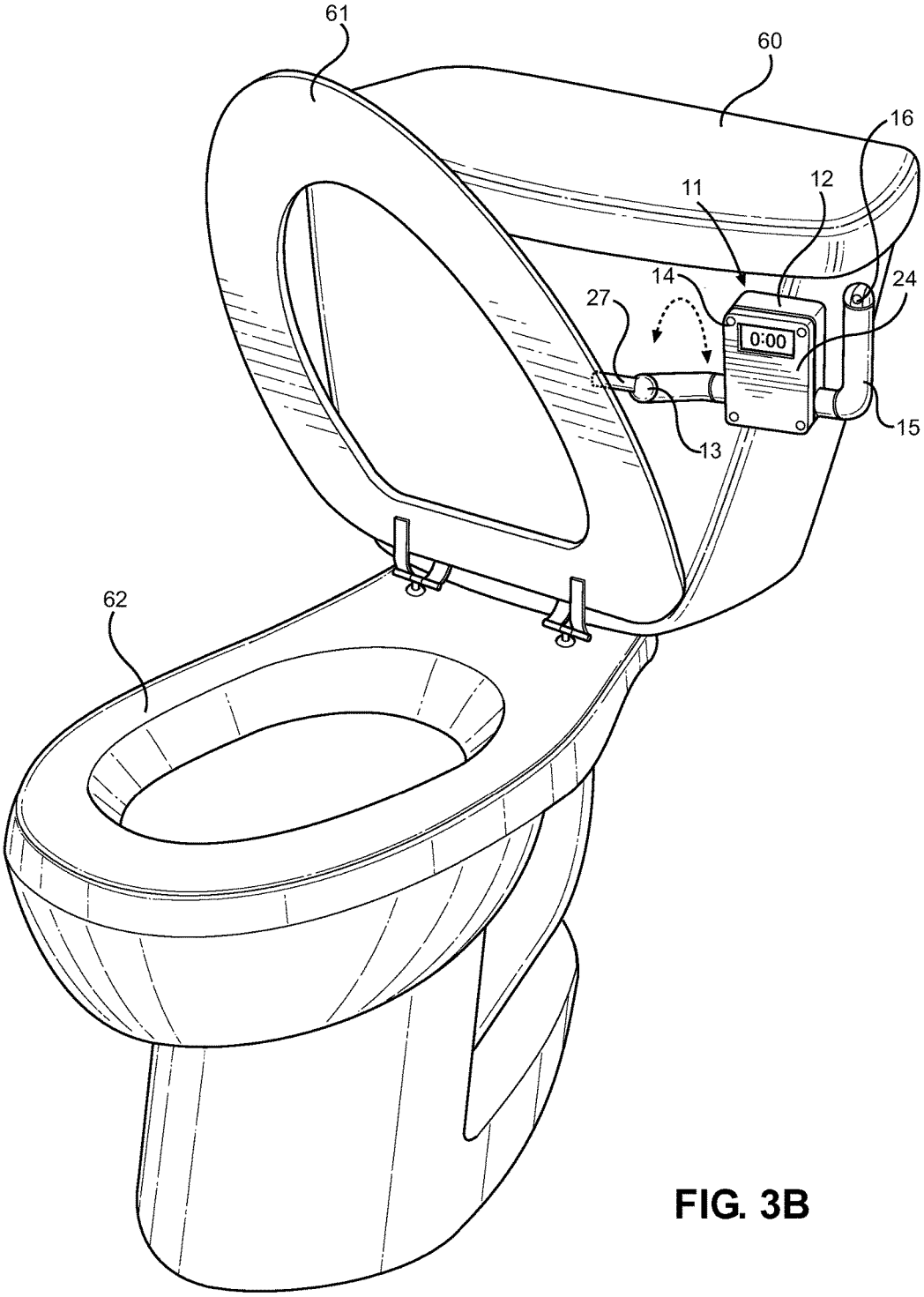
FIG. 3B shows a perspective view of an embodiment of the automatic toilet seat lowering device wherein the seat lowering arm is in a lowering configuration.

Referring now to FIGS. 3A and 3B, there is shown a perspective view of the automatic seat lowering device wherein the seat lowering arm is in an upright configuration and a perspective view of an embodiment of the automatic toilet seat lowering device wherein the seat lowering arm is in a lowering configuration, respectively. The seat lowering arm 13 is movable between an upright configuration and a lowered configuration. In the upright configuration, the toilet seat 61 is able to rest against the second member 27 of the seat lowering arm 13. In the lowered configuration, the seat lowering arm 13 is rotated downwards beyond the raised position of the toilet seat 61 so as to lower the toilet seat 61. The seat lowering arm 13 is vertical in the upright configuration and rotates outwards toward the toilet seat as it moves downwards. The seat lowering arm 13 is adapted to rotate up to 180 degrees. A user may position one or more cushioned elements on the underside of the toilet seat 61 so as to avoid the seat 61 from creating a noise when lowered. However, many toilet seats 61 are quiet closing by lowering at a slow rate, thereby preventing the seat 61 from slamming against the toilet 60.

In some embodiments, the laser pointing arm 15 is movable between a stored configuration and a working configuration so as to account for various sizes and dimensions of toilets 60 existing in the marketplace. When the automatic seat lowering device 11 is secured to a toilet 60, the placement of the laser pointing arm 15 may need to be rotated or adjusted in order for the laser light 16 to point towards the center of the toilet bowl 62. Furthermore, the placement of the laser pointing arm 15 when in a working configuration protrudes outward from the housing 12. Therefore, a user will want to compactly store the laser pointing arm 15 when not in use. In the stored configuration, the laser pointing arm 15 is disposed parallel to the front wall 24 of the housing 12 so as to avoid protruding outward therefrom. In the working configuration, the laser light 16 is directed towards the interior of the toilet bowl 62. The working configuration of the laser pointing arm 15 can be pre-set so as to automatically move, via a motor included within the housing 12, from the stored configuration to the working configuration upon detection of the toilet seat 61 resting against the seat lowering arm 13. However, in other embodiments, the laser pointing arm 15 is stationary and secured to the housing 12, wherein the portion in which the laser light 16 is secured to the laser pointing arm 15 is adjustable so as to allow the laser light to be redirected in order to point the laser light 16 towards the center of the toilet bowl. Thus, the entire laser pointing arm 15 will not be required to rotate when in the working configuration.

Figure 4:
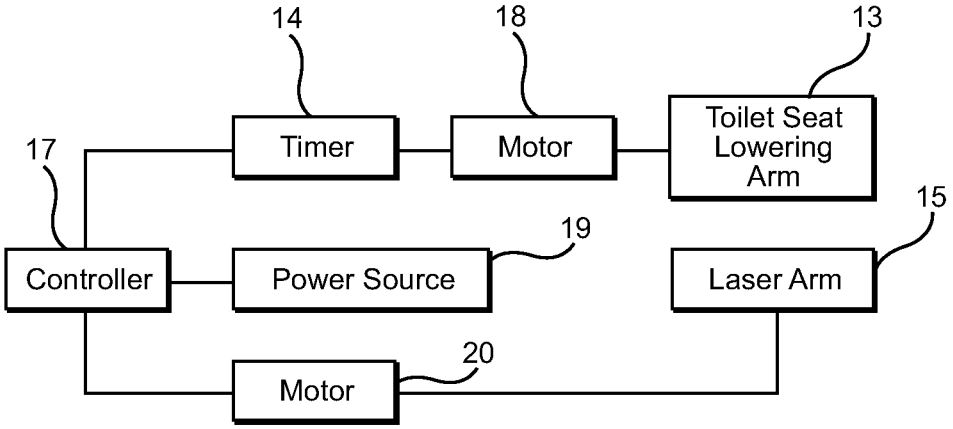
FIG. 4 shows a diagram of the control circuit of the automatic toilet seat lowering device.

Referring now to FIG. 4, there is shown a diagram of the control circuit of the automatic toilet seat lowering device. The automatic seat lowering device comprises a control circuit in which the controller 17 is operably connected to the motors 18, 20 of the seat lowering arm 13 and the laser arm 15. A first motor 18 is electrically connected to the seat lowering arm 13 and a second motor 20 is electrically connected to the laser pointing arm 15 via the control circuit. A power source 19 powers the motors 18, 20 and the timer 14 and is electrically connected thereto. The power source 19 may be one or more disposable or rechargeable batteries, wherein the batteries can be lithium ion, alkaline, or the like.

In operation, the user lifts a toilet seat so that it contacts the seat lowering arm, triggering the controller and starting the timer. Further, the controller triggers a first motor to rotate the laser pointing arm to a pre-set working configuration so as to point a laser light towards the center of the toilet bowl. The laser light is then turned on. After the time elapses, a second motor rotates the seat lowering arm to lower the toilet seat. The laser pointing arm is automatically rotated to an upright position and the laser light is turned off. Further, the seat lowering arm automatically returns to an upright position.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An automatic toilet seat lowering device, comprising:

a housing having a front wall, a rear wall, and one or more sidewalls;

a seat lowering arm pivotally secured to said housing and is movable between an upright configuration wherein a toilet seat is able to rest against said seat lowering arm and a lowered configuration wherein said seat lowering arm rotates so as to lower said toilet seat;

a timer disposed on said housing;

a controller on said seat lowering arm for detecting said toilet seat;

a motor disposed within said housing for pivoting said seat lowering arm towards said toilet seat;

a control circuit disposed within said housing and operably connecting said seat lowering arm to said controller, said timer, and said motor such that said controller initiates said timer and said motor rotates said seat lowering arm once said timer has expired;

a laser pointing arm disposed on said housing, wherein said laser pointing arm comprises a laser light disposed thereon that is configured to illuminate a point on an interior of a toilet bowl;

wherein said laser pointing arm is movable between a stored configuration wherein said laser pointing arm is disposed parallel to said front wall of said housing and a working configuration wherein said laser light is directed towards said interior of said toilet bowl.

2. The automatic seat lowering device of claim 1, wherein said seat lowering arm comprises an L-shaped configuration.

3. The automatic seat lowering device of claim 1, further comprising one or more attachment mechanisms disposed on said housing and configured to secure said housing to a tank of a toilet.

4. The automatic seat lowering device of claim 3, wherein said one or more attachment mechanisms is a hook configured to suspend said housing from said toilet.

5. The automatic seat lowering device of claim 3, wherein said one or more attachment mechanisms is adhesive disposed on said rear wall of said housing.

6. The automatic seat lowering device of claim 1, wherein said laser pointing arm is movable via a motor operably connected to said control circuit.

7. The automatic seat lowering device of claim 1, wherein said controller comprises a micro switch disposed in said seat lowering arm.

* * * * *